United States Patent [19]

Ekblom

[11] Patent Number: 4,679,376

[45] Date of Patent: Jul. 14, 1987

[54] ARRANGEMENT IN A ROLL WRAPPING APPARATUS FOR THE APPLICATION OF HEADERS

[75] Inventor: Karl-Erik Ekblom, Mäntsälä, Finland

[73] Assignee: Oy Wartsila AB, Helsinki, Finland

[21] Appl. No.: 815,006

[22] Filed: Dec. 31, 1985

[30] Foreign Application Priority Data

Dec. 31, 1984 [FI] Finland ..... 845174

[51] Int. Cl.[4] ..... B65B 61/22

[52] U.S. Cl. ..... 53/137; 53/211

[58] Field of Search ..... 53/128, 129, 137, 211, 53/217, 380, 587

[56] References Cited

U.S. PATENT DOCUMENTS

| | | | |
|---|---|---|---|
| 3,393,492 | 7/1968 | Lamon et al. | 53/137 |
| 3,828,523 | 8/1974 | Brenner et al. | 53/380 |
| 4,339,904 | 7/1982 | Koutonen et al. | 53/211 |
| 4,485,612 | 12/1984 | Piesen et al. | 53/137 |
| 4,534,151 | 8/1985 | Schneck et al. | 53/137 |

*Primary Examiner*—Robert L. Spruill
*Assistant Examiner*—Donald R. Studebaker
*Attorney, Agent, or Firm*—Birch, Stewart, Kolasch & Birch

[57] ABSTRACT

The present publication describes an arrangement in a roll wrapping apparatus for the application of headers (5), and in particular of soft headers, to the ends of paper rolls (1) or corresponding rolls. The arrangement comprises a header (5) storage unit (2), transfer unit (6), and an application unit (13). The suction head (15), acting as the grasping member of the application unit (13) is, according to the invention, fitted so as the grasp the header (5) over its center area and to set the header (5) into a revolving movement taking place in its own plane so as to keep the soft header (5) aligned by the effect of the centrifugal force until the application members (14) shift the header (5) onto the end of the roll (1). Owing to this arrangement, it is also possible to automatize the wrapping of rolls (1) by means of soft headers (5).

6 Claims, 2 Drawing Figures

ARRANGEMENT IN A ROLL WRAPPING APPARATUS FOR THE APPLICATION OF HEADERS

BACKGROUND OF THE INVENTION

1. Field of the Invention

The present invention is concerned with an arrangement in a roll wrapping apparatus for the application of headers, in particular of soft inner headers or equivalent, to the ends of paper rolls or corresponding rolls.

2. Description of the Prior Art

As a rule, such an arrangement includes a storage unit, in which there are storage members for different sizes of headers.

The arrangement further includes an application unit, which comprises grasping members for holding the header and setting members for transferring the header onto the end of the roll.

Each header is transferred from the storage unit to the application unit by means of a transfer unit in which there are also grasping members for holding the header and, moreover, transfer members for transferring the header from the storage unit to the grasping members of the transfer unit.

By means of the prior-art technique, it has been possible to automatize the transfer of rigid headers from the storage unit onto the roll end quite efficiently (cf., e.g., Finnish Patent No. 56,803). Such a rigid header can be shifted easily, e.g., by means of suction means (suction heads), because, owing to its rigidity, the header retains its shape even if it must be turned and shifted in different directions during the transfer.

It is evident that a soft header, e.g., an inner header of cardboard, cannot be transferred by means of the technique described above, because, during the transfer, the header would tend to be bent and folded, so that its application to the roll end would be impossible. This is the case in particular if, during the transfer, the header is grasped only by one point of limited area.

SUMMARY OF THE INVENTION

The object of the present invention is to eliminate the drawback described above and to provide an arrangement by means of which it is also possible to apply soft headers by means of an automatic machine.

The invention provides that, during the transfer, the header is set into a rotary movement taking place in its own plane, whereby centrifugal force keeps the header aligned during the transfer.

The greatest advantage obtainable by means of an arrangement in accordance with the invention is that it permits automatic wrapping of paper rolls and corresponding rolls also when soft inner headers are used.

BRIEF DESCRIPTION OF THE DRAWINGS

In the following, the invention will be examined in more detail by means of the exemplifying embodiment of the accompanying drawing.

DETAILED DESCRIPTION OF THE DRAWINGS

Figure 1:
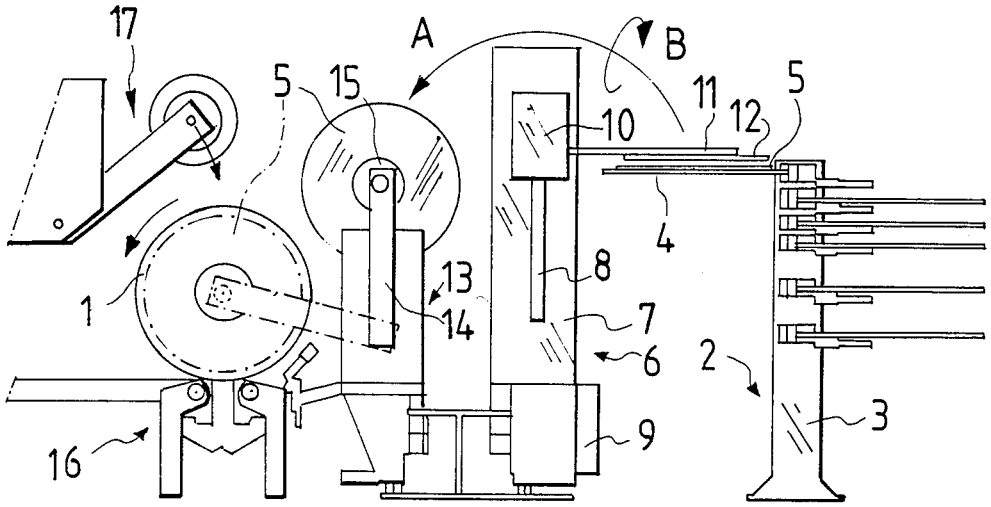
FIG. 1 is a side view of one arrangement in accordance with the invention.

The objective of the arrangement is to shift a soft header 5, placed in the storage unit 2, onto the end of a paper roll 1 when the roll 1 is on the wrapping table 16 rotating it. The storage unit 2 comprises a column 3, on which horizontal storage bases or members 4 are mounted for headers 5 of different sizes. In accordance with the diameter of the roll 1 that is being wrapped at each particular time, the storage base 4 carrying headers 5 of corresponding size is shifted to the delivery position by turning it in the horizontal plane. Such a storage unit is described, e.g., in the FI Patent No. 56,803.

Figure 2:
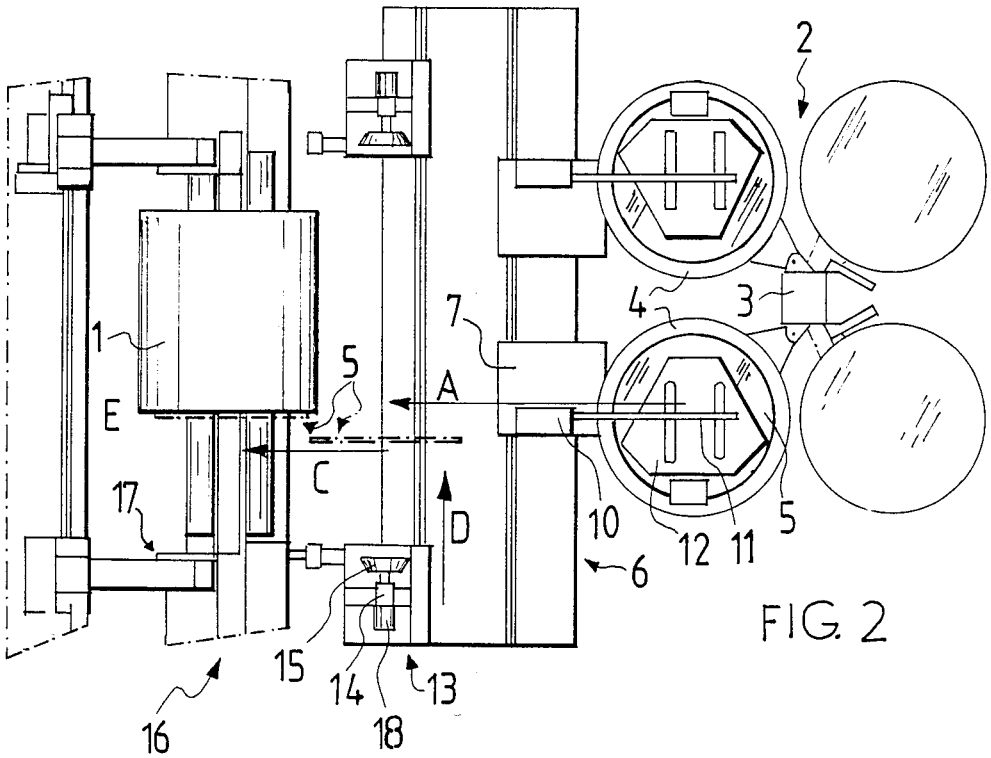
FIG. 2 is a top view of the arrangement shown in FIG. 1.

In the example case, the topmost storage base 4 has been turned to the delivery position. Since the arrangement applies the headers to both ends of the roll 1, as a matter of fact, it comprises two at least substantially identical systems. Thus, e.g., there are two storage bases 4 in the delivery position, as illustrated in FIG. 2.

Each transfer unit 6 comprises a frame 7, which is displaceable in the longitudinal direction of the apparatus. A servo unit 10, displaceable in the frame 7 vertically along a groove 8, is provided with a pivot arm 11, at whose end there is a grasping member 12 operating by the suction principle, the said member 12 being fitted so as to grasp the top face of the topmost header 5 in the stack over a wide area. The unit 10 can turn so that the arm 11 can perform an arc movement of 180° in the vertical plane the upper way. At the same time, the arm 11 is arranged to turn by 90° around its axis.

Now, when the grasping member 12 grasps the topmost header 5 place on the base 4, the unit 10 starts revolving anti-clockwise (FIG. 1), whereupon the arm 11 with its grasping member 12 and header 5 start performing an arc movement taking place the upper way (arrow A). At the same time, the arm 11 turns by 90° around its axis (arrow B), so that the header 5 moves in the vertical position, by-passing the side of the frame 7, to an intermediate position indicated by the arrows A, in which position it is facing the application unit 13. This application unit comprises a frame displaceable in the transverse direction of the apparatus (= in the direction of the axis of the roll 1) as well as an or member 14 pivotable in the radial plane of the roll 1. At the top end of the arm 14, there is a suction head 15 driven by the motor 18, which suction head 15 is fitted so as to grasp the centre of the header 5, at the same time as the grasping member 12 of the transfer unit 6, which supported the header from the other side over a wide area, is detached. The motor 18 is started now, whereby the soft header 5 remains aligned by the effect of the centrifugal force. At the same time, the arm 14 is pivoted from the vertical position towards the end of the roll 1 (arrow C). Hereupon the revolving header 5 is centered onto the end of the roll 1, at the same time as the roll 1 is rotated in the same direction. When contact is reached, the rotation of the header 5 is connected to idling mode, whereby its speed of rotation becomes equal to the speed of rotation of the roll 1 to be wrapped.

After the soft header 5 has been placed in its position on the end of the roll 1, the header 5 is supported by means of the suction head 15 so that it cannot be bent or folded until the folding device 17 has folded the wrapping paper surrounding the mantle of the roll 1 onto the edges of the header 5 placed on the roll end. Hereupon the contact of the suction head 15 is detached. The suction head 15 is preferably a suction cup which is made of rubber, e.g. polyurethane rubber or equivalent, and whose diameter is, e.g., 450 mm. The speed of revolving of the suction cup 15, which depends, e.g., on the diameter of the header 5 to be applied, it preferably within the range of 0.5 to 5.0 r.p.s.

FIG. 2 shows the location of the header 5 at the different stages, whereby the arrow E shows the ultimate shifting of the header 5, being pressed by the apllication device 13, against the end of the roll 1.

It should be noticed that, according to the invention, a transfer unit in accordance with the exemplifying embodiment is, in itself, not necessary, but the headers 5 may also be fitted to the application unit 13 manually. This is possible, e.g., in relatively slow wrapping apparatuses.

Since the movements and aligning operations of the various parts of the arrangement are in themselves known, the control system of the arrangement is not described at all in this connection.

What is claimed is:

1. An arrangement in a roll wrapping apparatus for the application of soft inner headers to the ends of paper rolls which comprises a storage unit, storage members located in said storage unit for carrying different size headers, a transfer unit having a frame, an application unit having a frame, first gripping means supported on said transfer unit frame for shifting a header from said storage unit to said application unit, second gripping means carried by said application unit frame for shifting the header to a position against the end of the roll, said second gripping means receiving the header from said first gripping means and holding the header over its center area, and means for rotating said second gripping means so as to keep the header aligned by the effect of centrifugal force while said seond gripping means shifts the header onto the end of the roll.

2. An arrangement as claimed in claim 1 wherein said second gripping means comprises a rotatable suction head.

3. An arrangement as claimed in claim 2 wherein said means for rotating said suction head is an adjustable speed motor.

4. An arrangement in a roll wrapping apparatus for the application of soft inner headers to the ends of paper rolls which comprises an application unit having a frame, means for shifting the header to a position against the end of the roll, said shifting means including an application member mounted on said application unit frame, gripping means located on said application member for holding the header over its center area during the shifting of the header to a position against the end of the roll, and means for rotating said gripping means so as to keep the header aligned by the effect of centrifugal force while said shifting means shifts the header onto the end of the roll.

5. An arrangement as claimed in claim 4 wherein said gripping means comprises a rotatable suction head.

6. An arrangement as claimed in claim 5 wherein said means for rotating said suction head is an adjustable speed motor.

* * * * *